US007063632B2

(12) United States Patent
Green

(10) Patent No.: US 7,063,632 B2
(45) Date of Patent: Jun. 20, 2006

(54) BASEBALL PRACTICE DEVICE

(76) Inventor: Randy J. Green, 3254 Melanie Cir., Pleasanton, CA (US) 94588

( * ) Notice: Subject to any disclaimer, the term of this patent is extended or adjusted under 35 U.S.C. 154(b) by 0 days.

(21) Appl. No.: 10/846,808

(22) Filed: May 14, 2004

(65) Prior Publication Data

US 2005/0255945 A1 Nov. 17, 2005

(51) Int. Cl.
*A63B 69/00* (2006.01)
*A63B 71/00* (2006.01)

(52) U.S. Cl. ..... 473/417; 473/422

(58) Field of Classification Search ..... 473/417–420, 473/431, 454, 462; 273/348, 407
See application file for complete search history.

(56) References Cited

U.S. PATENT DOCUMENTS 2,527,906 A * 10/1950 Bennett et al. ..... 473/417
4,445,685 A * 5/1984 Cardieri ..... 473/417
4,664,374 A * 5/1987 Groves ..... 473/417
4,819,937 A * 4/1989 Gordon ..... 473/417
4,962,924 A * 10/1990 James ..... 473/417
5,106,085 A * 4/1992 Lewy ..... 473/417
D373,806 S * 9/1996 Bunnell ..... D21/717
5,893,806 A * 4/1999 Martinez ..... 473/447
6,099,418 A * 8/2000 Owen ..... 473/417
2005/0143196 A1* 6/2005 Tsai ..... 473/417

* cited by examiner

*Primary Examiner*—Mitra Aryanpour
(74) *Attorney, Agent, or Firm*—Law Office of Steven B. Leavitt, L.L.P.; Steven B. Leavitt; John Pemberton

(57) ABSTRACT

A baseball practice equipment that sets up as a practice batting tee in one mode and converts to a practice pitching strike apparatus in a second mode. The practice batting tee has a base member, an extension, a vertical member with an upper end ball support and multiple mounting cavities for mounting the vertical member onto the base member and extension. The vertical member varies in height to adjust to the batter's height. The multiple mounting cavities are arranged between the base member and extension. As a second mode, the practice pitching strike zone has a base member, an extension, a first and second vertical members and mounting cavities for mounting the two vertical members. The first and second vertical members are adjusted in height such that a lower strike zone, middle strike zone and an upper strike zone is created between the vertical members.

20 Claims, 3 Drawing Sheets

BASEBALL PRACTICE DEVICE

BACKGROUND OF THE INVENTION

1. Technical Field

This invention relates generally to baseball and softball training equipment and, in particular, to a batting practice device that is convertible to a pitching practice device.

2. Description of Related Art

This invention relates to baseball batting practice equipment, specifically as applied to batting practice and pitching practice. While baseball batting practice equipment and baseball pitching practice equipment are well known in the art, convertible equipment or dual mode equipment is not as common and thus not as developed in the design of such equipment. The convertible equipment is the equipment that converts from a batting practice apparatus to a pitching practice apparatus and back as needed for practice.

U.S. Pat. No. 4,819,937 discloses a dual practice batting tee and practice strike pitching device. The batting tee includes first and second adjustable poles mounted on a base plate and extender members. The second stanchion has a support for resting a baseball. Because of the placement of the second stanchion relative to home plate, the batter contacts the ball in front of home plate when he assumes the normal batter's stance at home plate. The first pole is positioned and adjusted relative to the second pole to affect the desired swing.

The poles can be placed at selected locations on the home plate and adjusted in height so that the hitter may practice hitting the ball at locations corresponding to, for example, a high inside pitch, or a low inside pitch. The shortcoming with this arrangement, however, is that the first and second poles must be properly aligned in order to practice the proper swing.

As the practice strike pitching device, the poles are mounted in the extender so that they straddle the base. And indicators such as color bands on the pole surfaces provide the high-low range of the strike zone. The shortcoming of this prior art is the strike zone is small, narrow and difficult to utilize. For instance, the distance between the poles serving as goal posts is the same as the width of the home plate. Also, the narrow circumferential markings on the poles representing the high-low strike zone is difficult to use because the pitcher may not be able to ascertain if he pitched in the strike zone.

Often, a pitched ball having sufficient height that passes over and along a portion of one of the side edges of home plate will be considered by an umpire to be within the strike zone. What is needed is a pitching practice apparatus that allows the pitcher a strike zone slightly wider than the home plate where the pitcher can practice throwing the pitch for a strike. Also, the slightly wider than home plate zone can offer one the opportunity to practice pitching to the corners of home plate. Another aspect that is needed is multiple strike zones, such as a low, medium and a high strike zone, so that the pitcher can practice various strategies for a strike. Likewise, what is needed is a batting practice apparatus that allows a batter to practice hitting a ball from a tee approximating where the ball would be along one of the side edge of home plate. What is further needed is a combination device of a pitching and batting practice device that allows players to practice pitching and hitting along the side edges of home plate.

It is an object of the present invention to provide a practice pitching apparatus that is slighter wider than the home plate, so that the pitcher can practice pitching to the corners of home plate. Another object of the invention is to provide multiple strike zones, so that the pitcher can practice pitching to multiple strike zones. Another aspect of the invention is to provide a dual function practice apparatus, where one function is a practice tee and another function is a practice pitching strike apparatus. One other object of the present invention is to provide cost effective, safe and efficient baseball practice equipment which overcomes the limitations associated with prior batting and pitching practice equipment.

SUMMARY OF THE INVENTION

The present invention provides a cost effective, safe and efficient baseball practice equipment which overcomes the limitations associated with prior batting and pitching practice equipment. The baseball practice equipment of the present invention further allows for a double purpose function, with a practice batting tee in one mode and a practice pitching strike zone in the second mode.

In accordance with the first mode, the practice batting tee can be easily setup with minimal effort. The batting tee comprises a vertical member, a base member, an extension and a plurality of mounting means for attaching the vertical member. The vertical member has a lower stanchion, a middle stanchion and an upper stanchion which adjusts in height. The upper stanchion has an upper end that is dimensioned to hold a baseball or softball. The mounting means are arranged on the base member and extension to allow for mounting the vertical member such that a bat to ball contact is made along the corners of the base plate and in front of the base member.

In accordance with the second mode, the practice strike pitching apparatus setting is easily converted from the practice batting tee. The practice strike pitching apparatus consists of a first vertical member, a second vertical member, a base member, an extension and a plurality of mounting means for mounting the vertical members. Both vertical members have a lower stanchion telescopically connected to a middle stanchion, which is telescopically connected to an upper stanchion. The first vertical member is mounted to a first mounting means and the second vertical member is mounted to a second mounting means. The first and second vertical members are adjusted in height such that a lower strike zone is created between the first and second lower stanchions, a middle strike zone is created between the first and second middle stanchions, and an upper strike zone is created between the first and second upper stanchions. When the practice equipment is ready to be put away, the various components can be readily disassembled and stored in a tote bag or storage compartment with minimal effort and time.

It is a technical advantage of the present invention that baseball practice equipment be used safely and efficiently. It is a technical advantage that the batting practice apparatus allow for the batter to practice bat to ball contact on the corners and in front of the home plate. It is still a further technical advantage that the time is minimized for setting up the practice pitching strike equipment from the practice batting tee setup. It is a further advantage of the present invention that the pitcher can practice without the assistance of a catcher.

The foregoing and other objectives, features and advantages of the present invention will be more readily understood upon consideration of the following detailed description of the invention taken in conjunction with the accompanying drawings.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
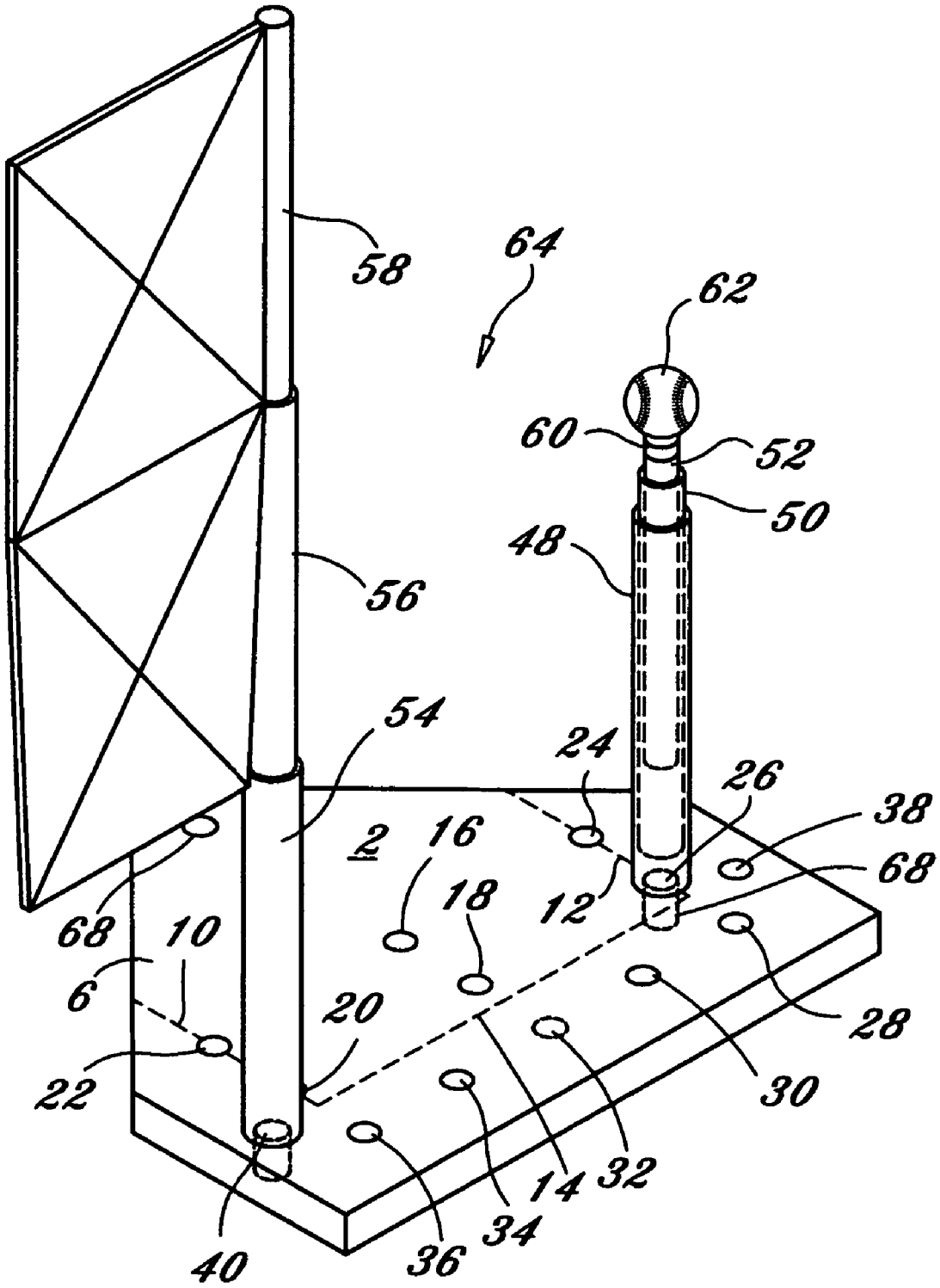
FIG. 1 is an elevation view of a base member, extension and multiple mounting means embodying the present invention.
Figure 2:
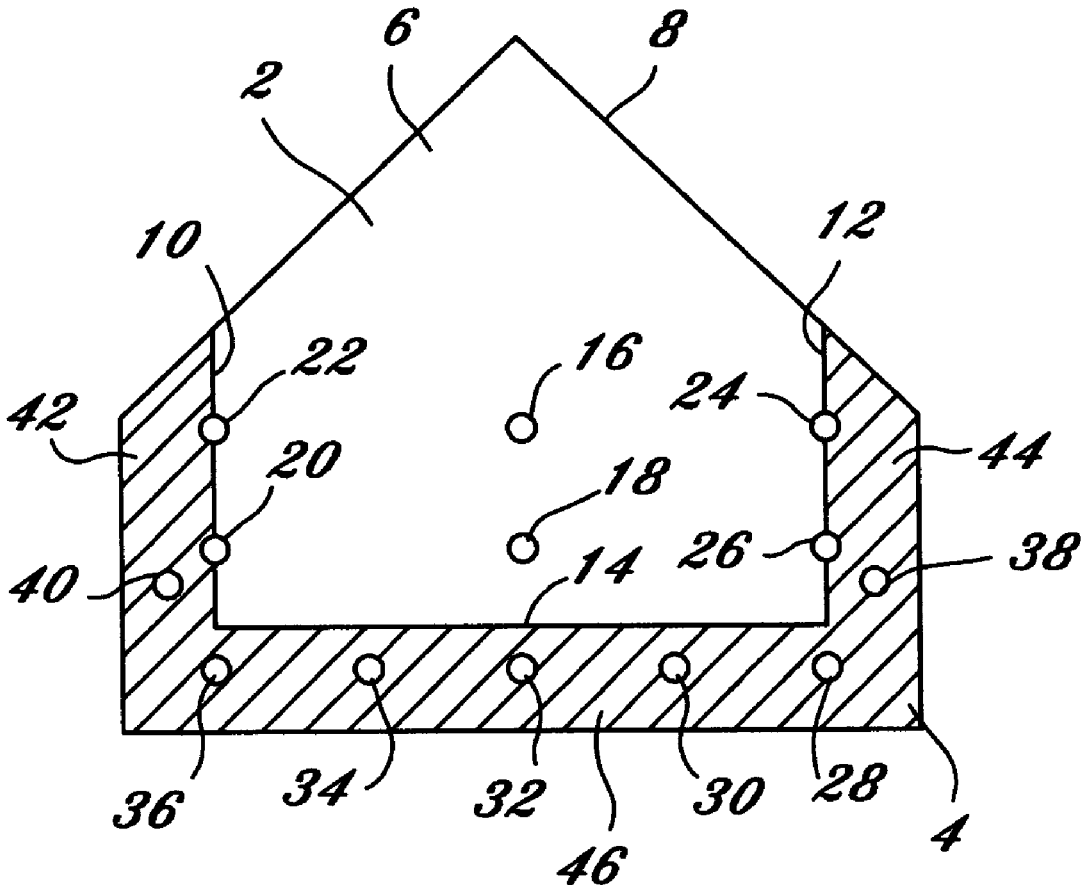
FIG. 2 is a top planar view of the base member of FIG. 1 without extension and mounting means affixed.
Figure 3:
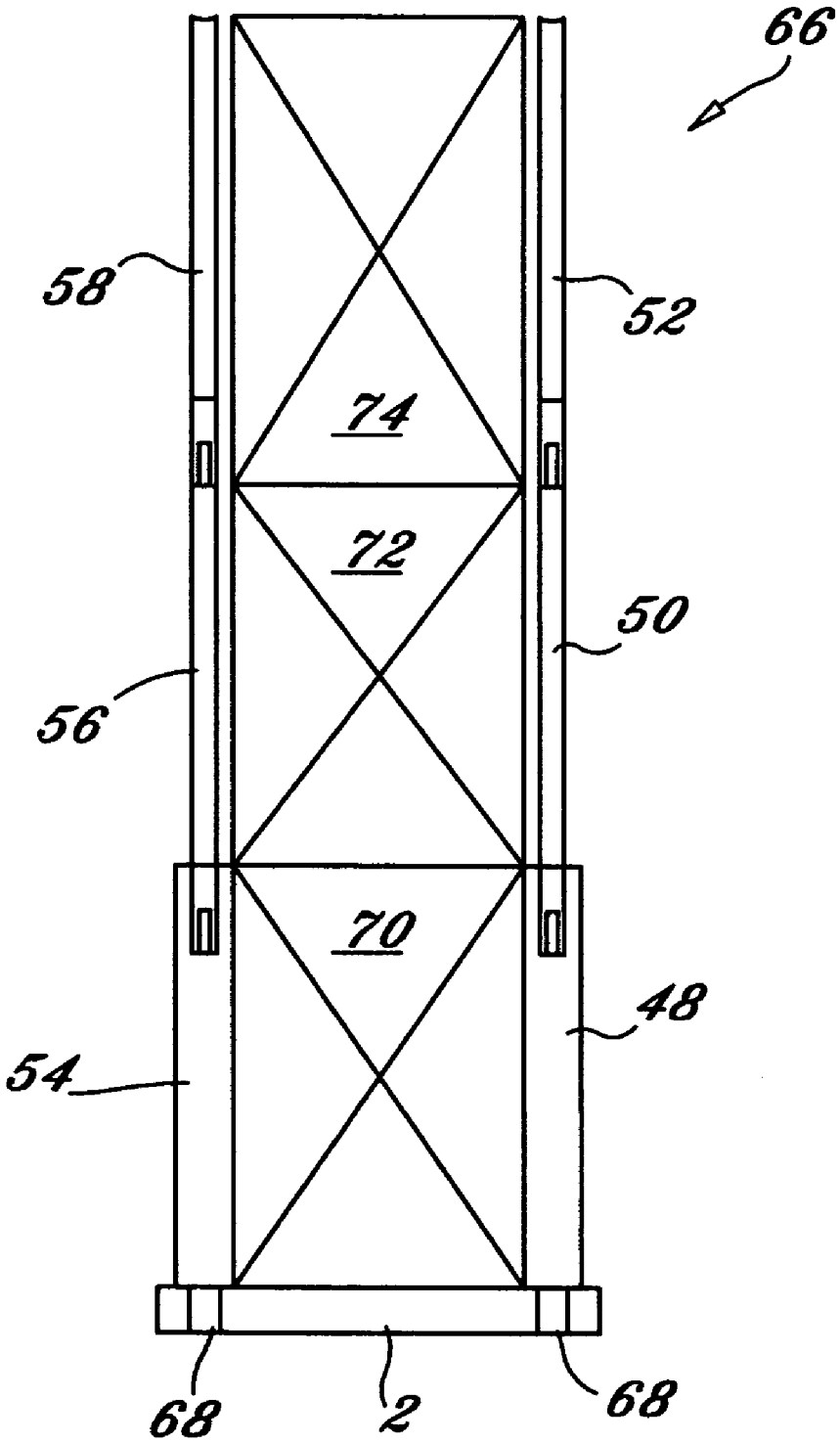
FIG. 3 is a front side planar view of the first vertical member and the second vertical member fully extended and arranged for pitching practice.

In FIGS. 1–3, like items are identified by like and corresponding numerals for ease of reference.

Referring now to the drawings, in FIG. 1, a batting practice apparatus 64 embodying the present invention is shown. The lower stanchion 48, middle stanchion 50 and the upper stanchion 52 are slidably connected to each other and mount onto the base member 6 at various locations as discussed further in FIG. 2. Lower stanchion 48 attaches to the base member 6 via a peg layer 2 at one end via a protrusion 68 and mates with a middle stanchion at the opposite end. Peg layer 2 is the portion of base member 6 that is outfitted with openings to receive and retain stanchions. The middle stanchion 50 mates to the lower stanchion 48 at the bottom end and mates with the upper stanchion 52 at the opposite end. The upper stanchion 52 mates with the middle stanchion 50 at the bottom end and supports a baseball 62 at the top end with a ball seating member 60. The ball seating member is configured to hold the ball 62.

The stanchions can be formed of any appropriate size. In the example shown in FIGS. 1–3, the lower stanchion 48 is 1 foot 10 inches in height and 2.5 inches in diameter, the middle stanchion 50 is 1 foot 6 inches in height and 2 inches in diameter, and the upper stanchion 52 is 1 foot 6 inches in height and 1.5 inches in diameter. The three stanchions are easily adjustable in height to accommodate users of different heights. This is achieved because the lower stanchion 48, middle stanchion 50 and upper stanchion 52 fit together utilizing a friction fit. In particular, the fit between the various stanchions may be a telescoping fit in which the individual members slide together in a coaxial fashion with friction holding the individual stanchion at desired positions.

The stanchions are preferably formed of a heavy duty rubber material which can be easily molded using a simple molding process. Other suitable, stiff yet pliable materials could also be used with the present invention. Alternatively, it would be possible to make the stanchions out of different materials, such as metal. However, it is necessary to have the upper stanchion 52 which supports the baseball be made of a flexible material so that when a batter swings the bat and accidentally hits the upper stanchion 52 it does not break nor will it injure the batter.

Referring to FIG. 2, the base member 6 is shown with a substantially u-shaped extension 4. Base member 6 is pentagonal shaped as a baseball home plate with a front edge 14, a v-shaped back edge 8, a first parallel side edge 10 and a second parallel side edge 12. The extension 4 has a longitudinal portion 46, a first parallel portion 42 and a second parallel portion 44. The base member 6 and the extension 4 are attached at various edges. The first parallel side edge 10 abuts the first parallel portion 42. The front edge 14 abuts the longitudinal portion 46. The second parallel side edge 12 abuts the second parallel portion 44. In one embodiment, not shown, the base member 6 and the extension 4 are connected by interlocking means. In another embodiment, the base member 6 and the extension 4 are fabricated as one unit, such that the base member 6 and extension 4 cannot be disconnected from each other. The base member 6 and the extension 4 are preferably formed of a heavy duty rubber material which can be easily molded using a simple molding process. However, other materials can be utilized such as rigid plastic, metal, wood or wood particle materials. In one embodiment, the base member 6 and extension 4 are attached and beveled at the outer edges and are 2 inches in thickness, 1 foot 10 inches in length at the longitudinal portion 46 and 1 foot 5 inches in length measuring from the front edge of the longitudinal portion 46 to the back point of the v-shaped back edge 8. The first parallel portion 42 and the second parallel portion 44 are each 2.5 inches in width, and the longitudinal portion 46 is 3 inches in width.

The various mounting means 16–40 are arranged throughout the base member 6 and the extension 4 depending on the desired location of practice concentration. For instance, first side mounting means 22 and 20 are positioned on the first parallel portion 42 of extension 4 and first parallel side edge 10 of base member 6 and can be utilized for practicing batting on the right outer edge of home plate. Second side mounting means 24 and 26 are positioned on the second parallel portion 44 of extension 4 and second parallel side edge 12 of base member 6 and can be utilized for practicing batting on the left outer edge of home plate. Front mounting means 28–36 are positioned on the longitudinal portion 46 of the extension 4 and parallel to the front edge 14 of base member 6 and can be utilized for practicing batting on the front of home plate. Center mounting means 16 and 18 are positioned halfway between the first parallel side edge 10 and second parallel side edge 12 and can be utilized for practicing batting on the middle of home plate.

First mounting means 40 is positioned on first parallel portion 42 of the extension 4. Second mounting means 38 is positioned on second parallel portion 44 of the extension 4. The location of mounting means 38 and 40 are utilized for mounting the lower stanchions 48 and 54 and practicing the pitching techniques, discussed further in FIG. 3.

Referring to FIG. 1, the lower stanchions 48 and 54 may be positioned in whichever mounting means 16–40 as may be practical in order to facilitate the practicing of pitching. Stanchion 48 may be positioned in any mounting means on base member 6. While shown in FIG. 1 with stanchion 48 outfitted for batting practice and stanchion 54 being outfitted for pitching practice, normally the present invention would be set up for either batting or pitching practice. Hence, base member 64 is shown in FIG. 1 with both a batting and pitching arrangement for demonstrative purposes.

In one embodiment, the first side mounting means 22 is 3.5 inches from first side mounting means 20 and 8.5 inches from center mounting means 16. First side mounting means 20 is 3.5 inches from front mounting means 36 and 8.5 inches from center mounting means 18. Front mounting means 28, 30, 32, 34, and 36 are 4.25 inches from each other while front mounting means 28 and 36 are 2.5 inches from the outer edge of the second parallel portion 44 and first parallel portion 42 respectively. Second side mounting means 24 is 3.5 inches from second side mounting means 26 and 8.5 inches from center mounting means 16. Second side mounting means 26 is 3.5 inches from front mounting means 28 and 8.5 inches from center mounting means 18. First mounting means 40 and second mounting means 38 are 4.25 inches from the front edge of the longitudinal portion 46.

Referring to FIG. 3, the pitching practice apparatus 66 is shown and includes the first lower stanchion 48 slidably connected to first middle stanchion 50 which is slidably connected to first upper stanchion 52, the second lower stanchion 54 slidably connected to second middle stanchion 56 which is slidably connected to second upper stanchion 58. The first lower stanchion 48 is mounted to the first mounting means 40 and the second lower stanchion 54 is mounted to second mounting means 38. The stanchions 48 and 54 are mounted via a protrusion 68.

The stanchions are fully extended to provide the pitcher with multiple strike zones. A lower strike zone 70 is created between the first lower stanchion 48 and the second lower stanchion 54. A middle strike zone 72 is created between the first middle stanchion 50 and the second middle stanchion 56. An upper strike zone 74 is created between the first upper stanchion 52 and the second upper stanchion 58. The stanchions may be extended only partially such that only a lower strike zone 70 is created or the stanchions may be extended further such that only a lower strike zone 70 and a middle strike zone 72 is created. Any of these variations in height will offer the pitcher the opportunity to refine and improve his pitching skills both safely and efficiently.

It is understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A batting practice apparatus comprising:

a vertical member having a telescopically adjustable lower stanchion member slidably connected to a telescopically adjustable middle stanchion member, which is slidably connected to a telescopically adjustable upper stanchion member;

a base member for supporting said lower stanchion member in an upright position, said base member having a pentagonal shape substantially similar to a baseball home-plate with a front edge, a v-shaped back edge, a first parallel side edge and a second parallel side edge extending between said front edge and said back edge;

said base member having a plurality of center mounting means arranged substantially centered between said first parallel side edge and said second parallel side edge;

a substantially u-shaped extension having a longitudinal portion, a first parallel portion and a second parallel portion, said longitudinal portion abutting said front edge of said base member, said first parallel portion abutting said first parallel side edge of said base member, said second parallel portion abutting said second parallel side edge of said base member; and said extension having a plurality of front mounting means arranged substantially parallel to said front edge of sad base member, a plurality of first side mounting means arranged substantially on said first parallel portion and said first parallel side edge of said base member, a plurality of second side mourning means arranged substantially on said second parallel portion and said second parallel side edge of said base member.

2. The apparatus of claim 1, wherein said vertical member is mounted to a selected one of said mounting means and said middle stanchion and said upper stanchion are held at an optimum height relative to said lower stanchion by a friction fit.

3. The apparatus of claim 2, wherein the mounting means is proximate to said first parallel side edge of said base member.

4. The apparatus of claim 2, wherein the mounting means is proximate to said second parallel side edge of said base member.

5. The apparatus of claim 1, wherein said vertical member is mounted to a selected one of said mounting means so that a ball contact is effected in front of said base member and said middle stanchion and said upper stanchion are held at an optimum height relative to said lower stanchion by a friction fit.

6. The apparatus of claim 1, wherein said base member and said extension are made of a durable rubber material, and said base member is connectably attached to said extension, wherein said base member is beveled at said v-shaped back edge, and said extension is beveled at; an outer edge of said longitudinal portion, an outer edge of first parallel portion, and an outer edge of second parallel portion.

7. The apparatus of claim 1, wherein said base member and said extension are fabricated as a contiguous unit.

8. A pitching practice apparatus comprising:

a first vertical member having a telescopically adjustable first lower stanchion member slidably connected to a telescopically adjustable first middle stanchion member, which is slidably connected to a telescopically adjustable first upper stanchion member;

a second vertical member having a telescopically adjustable second lower stanchion member slidably connected to a telescopically adjustable second middle stanchion, which is slidably connected to a telescopically adjustable second upper stanchion member;

a base member for supporting said first lower stanchion member in an upright position and said second lower stanchion member in an upright position, said base member having a pentagonal shape substantially similar to a baseball home-plate with a front edge, a v-shaped back edge and a first parallel side edge and a second parallel side edge extending between said front edge and said back edge;

a substantially u-shaped extension having a longitudinal portion, a first parallel portion and a second parallel portion, said longitudinal portion abutting said front edge of said base member, said first parallel portion abutting said first parallel side edge of said base member, said second parallel portion abutting said second parallel side edge of said base member;

said extension including a plurality of first mounting means arranged substantially centered in said first parallel portion, a plurality of second mounting means arranged substantially centered in said second parallel portion; and said first vertical member is mounted in said first mounting means and said second vertical member is mounted in said second mounting means.

9. The apparatus of claim 8, wherein said first vertical member and said second vertical member are adjustable in height relative to said base member to form a desired strike zone.

10. The apparatus of claim 9, wherein the desired strike zone may be a lower strike zone created between said first lower stanchion and said second lower stanchion, a middle strike zone created between said first middle stanchion and said second middle stanchion, or an upper strike zone created between said first upper stanchion and said second upper stanchion.

11. A baseball practice apparatus comprising:

a first vertical member having a telescopically adjustable first lower stanchion member slidably connected to a telescopically adjustable first middle stanchion member which is slidably connected to a telescopically adjustable first upper stanchion member;

a second vertical member having a telescopically adjustable second lower stanchion member slidably connected to a telescopically adjustable second middle stanchion which is slidably connected to a telescopically adjustable second tipper stanchion member;

a base member for supporting said first lower stanchion member in an upright position and said second lower stanchion member in an upright position, said base member having a pentagonal shape substantially similar to a baseball home-plate with a front edge, a v-shaped back edge, a first parallel side edge and a second parallel side edge extending between said front edge and said back edge;

a substantially u-shaped extension having a longitudinal portion, a first parallel portion and a second parallel portion, said longitudinal portion abutting said front edge of said base member, said first parallel portion abutting said first parallel side edge of said base member, said second parallel portion abutting said second parallel side edge of said base member; and said extension having a plurality of first mounting means arranged substantially centered in said first parallel portion, a plurality of second mounting means arranged substantially centered in said second parallel portion, a plurality of front mounting means arranged substantially parallel to said front edge of said base member, a plurality of first side mounting means arranged substantially on said first parallel portion and said first parallel side edge of said base member, a plurality of second side mounting means arranged substantially on said second parallel portion and second parallel side edge of said base member.

12. The apparatus of claim 11, wherein said first vertical member is mounted is said first mounting means and said second vertical member is mounted in said second mounting means.

13. The apparatus of claim 12, wherein said first vertical member and second vertical member are adjusted in height such that a lower strike zone is created between said first lower stanchion and said second lower stanchion, a middle strike zone is created between said first middle stanchion and second middle stanchion, and an upper strike zone's created between said first upper stanchion and said second upper stanchion.

14. The apparatus of claim 11, wherein a batting practice apparatus is setup wherein said first vertical member is mounted to a selected one of said mounting means so that a ball contact is effected over said side edge of said base member, with said first middle stanchion and said upper stanchion held at an optimum height relative to lower stanchion by a friction fit.

15. The apparatus of claim 14, wherein the mounting means is proximate to said first parallel side edge of said base member.

16. The apparatus of claim 14, wherein the mounting means is proximate to said second parallel side edge of said base member.

17. The apparatus of claim 11, wherein a batting practice apparatus is setup wherein said first vertical member is mounted to a selected one of said mounting means so that a ball contact is effected in front of said base member, with said first middle stanchion and said upper stanchion held at an optimum height relative to lower stanchion by a friction fit.

18. The apparatus of claim 11, wherein said base member and said extension are made of a durable rubber material, said base member is connectably attached to said extension.

19. The apparatus of claim 18, wherein said base member is beveled at said v-shaped back edge, and said extension is beveled at an outer edge of said longitudinal portion, an outer edge of first parallel portion, and an outer edge of second parallel portion.

20. The apparatus of claim 11, wherein said base member and said extension are fabricated as a contiguous unit.

* * * * *